US011035598B2

(12) United States Patent
Staines

(10) Patent No.: US 11,035,598 B2
(45) Date of Patent: Jun. 15, 2021

(54) METHOD AND APPARATUS FOR CRYOGENIC COOLING OF HTS DEVICES IMMERSED IN LIQUID CRYOGEN

(71) Applicant: VICTORIA LINK LTD, Wellington (NZ)

(72) Inventor: Michael Staines, Lower Hutt (NZ)

(73) Assignee: FABRUM SOLUTIONS LIMITED, Christchurch (NZ)

( * ) Notice: Subject to any disclaimer, the term of this patent is extended or adjusted under 35 U.S.C. 154(b) by 464 days.

(21) Appl. No.: 15/324,617

(22) PCT Filed: Jul. 6, 2015

(86) PCT No.: PCT/IB2015/055103

§ 371 (c)(1),
(2) Date: Jan. 6, 2017

(87) PCT Pub. No.: WO2016/005882

PCT Pub. Date: Jan. 14, 2016

(65) Prior Publication Data

US 2017/0205124 A1 Jul. 20, 2017

Related U.S. Application Data

(60) Provisional application No. 62/021,612, filed on Jul. 7, 2014.

(51) Int. Cl.
*H01F 6/04* (2006.01)
*F25B 19/00* (2006.01)
(Continued)

(52) U.S. Cl.
CPC ..... *F25B 19/005* (2013.01); *F25D 17/02* (2013.01); *F25D 19/00* (2013.01); *F25D 29/001* (2013.01);
(Continued)

(58) Field of Classification Search
CPC .. H01F 6/04; F17C 2250/0631; F25B 19/005; F25D 29/001
See application file for complete search history.

(56) References Cited

U.S. PATENT DOCUMENTS 3,195,620 A * 7/1965 Steinhardt, Jr. ..... F17C 3/085 165/104.14
4,689,439 A * 8/1987 Sato ..... F25D 3/10 174/11 R
(Continued)

FOREIGN PATENT DOCUMENTS

CN 1066763735 B 7/2019
JP 2007-005552 A 1/2007

OTHER PUBLICATIONS

Kang, H. et al. (2005). Sub-cooled nitrogen cryogenic cooling system for superconducting fault current limiter by using GM-cryocooler. Cryogenics, 45, 65-69.
(Continued)

*Primary Examiner* — David J Teitelbaum
(74) *Attorney, Agent, or Firm* — Polsinelli PC

(57) ABSTRACT

A thermally insulated vessel contains a thermal insulation barrier defining an upper compartment above the barrier and a lower compartment below the barrier. The compartments are interconnected by a passage to allow pressure equalization. High temperature superconductor is mounted within the lower compartment for immersion in the liquid cryogen. A cryogenic refrigerator has a cold head thermally coupled to the high temperature superconductor for maintaining the high temperature superconductor below a superconductive transition temperature. A temperature controller maintains a temperature of the liquid cryogen in the upper compartment at a temperature of at least a boiling point of the liquid cryogen at atmospheric pressure when the lower compart-
(Continued)

ment and at least a portion of the upper compartment are filled with the liquid cryogen.

20 Claims, 5 Drawing Sheets

(51) Int. Cl.
*F25D 19/00* (2006.01)
*F25D 17/02* (2006.01)
*F25D 29/00* (2006.01)

(52) U.S. Cl.
CPC ..... *H01F 6/04* (2013.01); *F25D 2400/02* (2013.01); *F25D 2700/121* (2013.01)

(56) References Cited

U.S. PATENT DOCUMENTS 4,689,469 A 8/1987 Sato
4,978,832 A * 12/1990 Rubin ..... F17C 7/04 392/400
5,150,578 A 9/1992 Oota et al.
5,220,800 A 6/1993 Muller et al.
5,721,522 A * 2/1998 Roth ..... G01R 33/3815 324/318
2005/0028537 A1 2/2005 Yuan et al.
2005/0198974 A1 9/2005 Roth
2006/0064989 A1 * 3/2006 Roth ..... F25B 9/02 62/51.1
2010/0113282 A1 * 5/2010 Kawashima ..... F25D 19/006 505/163
2012/0242335 A1 * 9/2012 Schett ..... G01R 33/3403 324/318

OTHER PUBLICATIONS

Yazawa, T. et al. (2001). Design and test results of 6.6 kV high-Tc superconducting fault current limiter. IEEE Transactions on Applied Superconductivity, 11(1), 2511-2514.
Sauers, I. et al. (2011). Effect of bubbles on liquid nitrogen breakdown in plane-plane electrode geometry from 100-250 kPa. IEEE Transactions on Applied Superconductivity, 21(3), 1892-1895.
Tseng, C. et al. (1997). Thermal conductivity of polyurethane foams from room temperature to 20 K. Cryogenics, 37(6), 305-312.
International Search Report, PCT/IB2015/055103.
Written Opinion of the International Searching Authority, PCT/IB2015/055103.
Official Action for Chinese Patent Application No. 201580043419.8 dated Jul. 26, 2018.
Notice of Grant for Chinese Patent Application No. 201580043419.8 dated Apr. 17, 2019.
Response to official action for Chinese Patent Application No. 201580043419.8 dated Jan. 31, 2019 and English translation of allowed claims.

* cited by examiner

Fig. 4
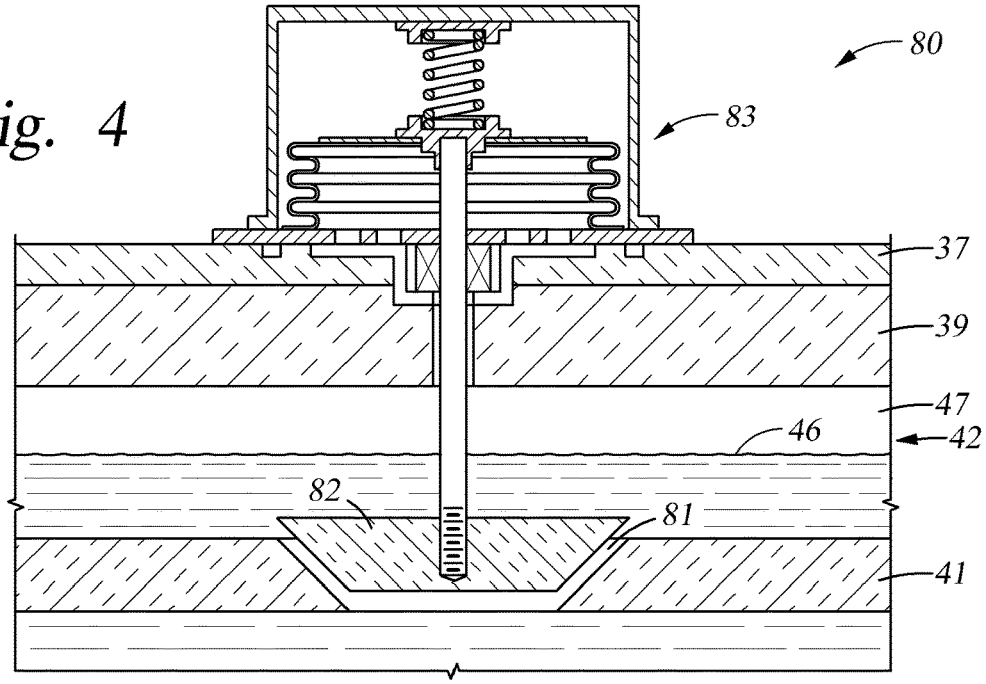
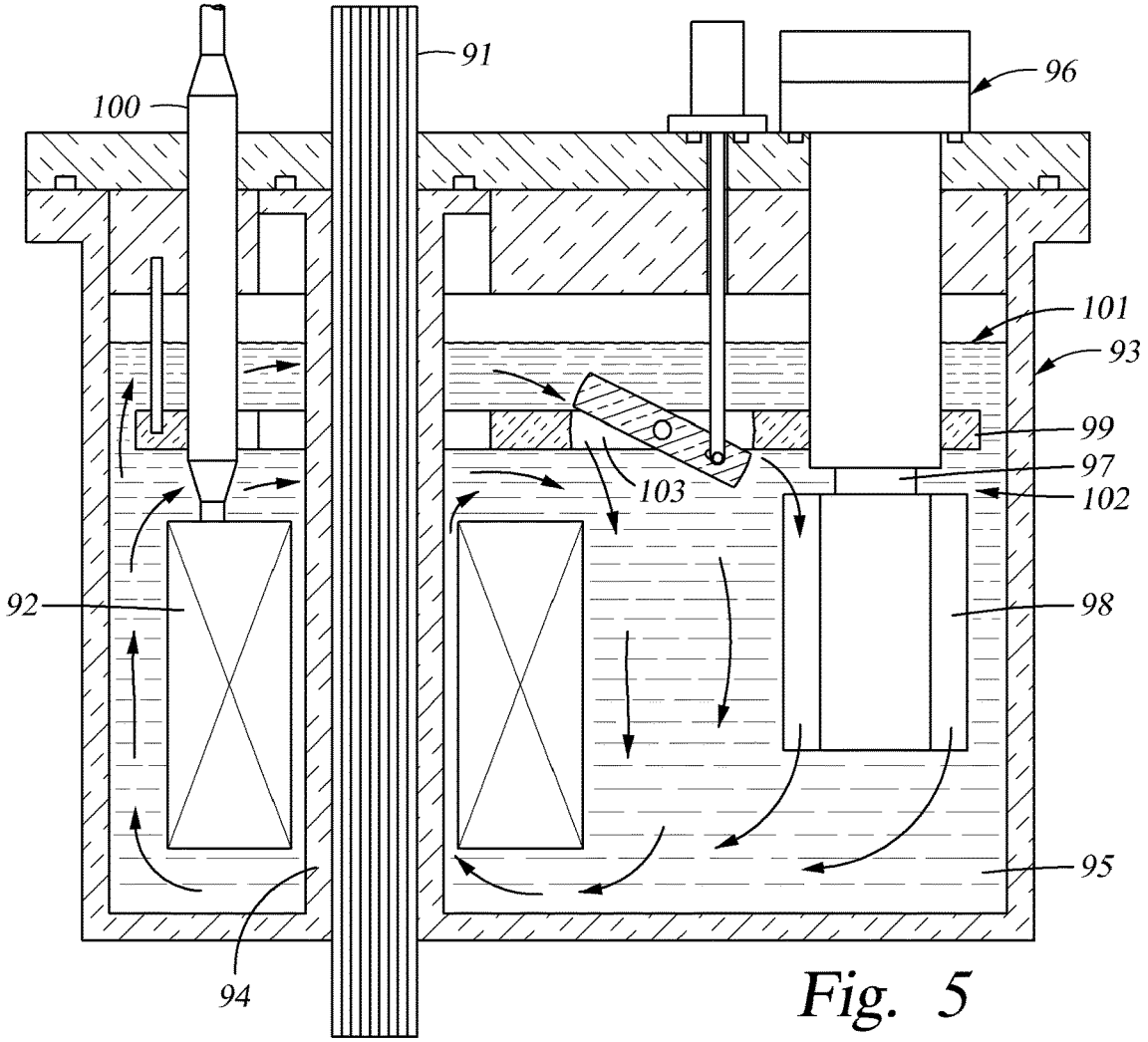
Fig. 5

METHOD AND APPARATUS FOR CRYOGENIC COOLING OF HTS DEVICES IMMERSED IN LIQUID CRYOGEN

RELATED APPLICATIONS

This application is a national stage application (under 35 U.S.C. § 371) of PCT/IB2015/055103, filed Jul. 6, 2015, which claims priority to U.S. Provisional Application No. 62/021,612, filed Jul. 7, 2014.

TECHNICAL FIELD

This disclosure relates to a method and apparatus for cryogenic cooling of high temperature superconductor (HTS) devices immersed in liquid cryogen.

BACKGROUND ART

The properties of common materials often change when the materials are cooled to a cryogenic temperature, and these changes complicate the design of cryogenic apparatus. These changes become substantial below a temperature of about 150 degrees Kelvin. Therefore, in this disclosure, "cryogenic" relates to a temperature below 150 degrees Kelvin. For example, "cryogenic liquid" is a liquid that has a boiling point below 150 degrees Kelvin. Examples of cryogenic liquid include liquid helium, hydrogen, neon, nitrogen, fluorine, argon, oxygen, and krypton.

High temperature superconductor (HTS) is a superconductor having a transition temperature above thirty degrees Kelvin (−243.2° C.). The transition temperature is the temperature below which the superconductor becomes superconducting in the absence of a magnetic field. In the presence of a magnetic field, the superconductor becomes superconducting at a temperature lower than the transition temperature. At a temperature lower than the transition temperature, there is a critical current density above which the superconductor exhibits significant resistance, by definition at an electric field of 1 μV/cm. Therefore is it often desirable to operate a HTS magnet at a temperature substantially lower than the transition temperature in order to achieve high current densities.

A number of HTS have a relatively high critical current density in a temperature range (63.15 to 77.35 degrees Kelvin) for which nitrogen is a liquid at atmospheric pressure. Some of these HTS are in commercial production, such as Bi2223, and $YBa_2Cu_3O_7$ and the rare-earth substituted variants of $YBa_2Cu_3O_7$ referred to as REBCO or more loosely as 2G HTS conductors. Therefore liquid nitrogen is a most convenient and relatively inexpensive refrigerant or heat transfer fluid for use with these HTS.

Usually a superconducting device is operated so that the magnet current is significantly less than the critical current. Otherwise, there is a likelihood that the superconducting magnet may revert to a non-superconducting state, causing a release of heat from current flowing in the magnet. Such an event of losing the superconducting state is called a quench. To prevent the release of heat during a quench from damaging the superconducting magnet, the superconducting magnet often is immersed in liquid cryogen so that the liquid cryogen may boil off to absorb the heat. Although a quench usually is not desired, a superconducting fault current limiter relies on a controlled quench in order to limit a fault current that substantially exceeds a normal level of current. See, for example, Yazawa et al., Design and Test Results of 6.6 kV High-Tc Superconducting Fault Current Limiter, IEEE Transactions on Applied Superconductivity, Vol. 11, No. 1, March 2001, pp. 2511-2514.

The 2G HTS conductor has a critical temperature of about 90 degrees Kelvin, and the critical current is improved substantially by lowering the operating temperature well below the liquid nitrogen boiling point of 77.35 degrees Kelvin. The critical current of 2G conductor, for example, typically increases by 7% per degree Kelvin temperature reduction. The temperature can be lowered by suction pumping on the liquid nitrogen so that the liquid nitrogen boils off. The lower limit is the critical point of nitrogen, 63.15 K at a pressure of 12.5 kPa. However, suction pumping requires a continuous supply of liquid nitrogen, or the complexity of a compressor and condenser to re-liquefy the nitrogen vapor. The low pressure is also undesirable because the vessel needs to withstand the external pressure of the atmosphere, and any leaks in the vessel would contaminate the cryogen with atmospheric oxygen and water vapor. In addition, boiling of the cryogen produces gas bubbles adversely affecting the electrical breakdown strength of the cryogen. See Sauers et al., Effect of Bubbles on Liquid Nitrogen Breakdown in Plane-Plane Electrode Geometry from 100-250 kPa, IEEE Transactions on Applied Superconductivity, Vol. 21, No. 3, June 2011, pages 1892-1895.

In view of the considerations discussed above, HTS devices such as fault current limiters have been immersed in liquid cryogen contained in a cryostat vessel and cooled to well below the boiling point of the liquid cryogen at atmospheric pressure, and the pressure in the cryostat vessel has been maintained at or above atmospheric pressure in various ways. For example, Yazawa et al., cited above, says a pressure regulator keeps the pressure inside the bath of the cryostat at atmospheric pressure so as to keep an electric insulation condition. Another example is found in Kang et al., Sub-cooled nitrogen cryogenic cooling system for superconducting fault current limiter by using GM-cryocooler, Cryogenics 45 (2005) pages 65-69, which says that a pressure of 1 atmosphere was controlled by injecting non-condensable gas, GHe, into a sub-cooled nitrogen cooling system. Another example is found in Yuan et al. U.S. Pat. No. 6,854,276 issued Feb. 15, 2005, in which a sub-cooled liquid cryogen bath is covered by a thermal gradient boundary region adjacent to a pressurized gaseous cryogen region.

SUMMARY OF THE DISCLOSURE

In accordance with one aspect, the disclosure describes a high temperature superconductor apparatus. The apparatus includes a thermally insulated vessel for containing liquid cryogen, and a thermal insulation barrier disposed in the vessel and defining an upper compartment within the vessel above the barrier and a lower compartment within the vessel below the barrier, and the upper compartment is interconnected to the lower compartment by a passage to allow pressure equalization between the upper compartment and the lower compartment. High temperature superconductor is mounted within the lower compartment for immersion in the liquid cryogen. A cryogenic refrigerator has a cold head thermally coupled to the high temperature superconductor for maintaining the high temperature superconductor below a transition temperature for superconductivity. The apparatus also includes a temperature controller for maintaining a temperature of the liquid cryogen in the upper compartment at a temperature of at least a boiling point of the liquid cryogen at atmospheric pressure when the lower compartment and at least a portion of the upper compartment are filled with the liquid cryogen.

In accordance with another aspect, the disclosure describes a method of operating a high temperature superconductor apparatus. The apparatus has a thermally insulated vessel containing liquid cryogen, a thermal insulation barrier disposed in the vessel and defining an upper compartment within the vessel above the barrier and a lower compartment within the vessel below the barrier. The upper compartment is interconnected to the lower compartment by a passage to allow pressure equalization between the upper compartment and the lower compartment. Liquid cryogen is contained in the lower compartment and in at least a portion of the upper compartment. High temperature superconductor is mounted within the lower compartment and immersed in the liquid cryogen, and a cryogenic refrigerator has a cold head thermally coupled to the high temperature superconductor to maintain the high temperature superconductor below a transition temperature for superconductivity. The method includes maintaining a temperature of the liquid cryogen in the upper compartment at a temperature of at least a boiling point of the liquid cryogen at atmospheric pressure.

BRIEF DESCRIPTION OF THE DRAWINGS

FIG. 4 is a schematic diagram of a mechanical temperature control mechanism substituted for the electronic control shown in FIGS. 1 and 2;

FIG. 5 is a schematic diagram of a second apparatus including a high temperature superconducting device that uses one or more ferromagnetic cores.

Figure 1:
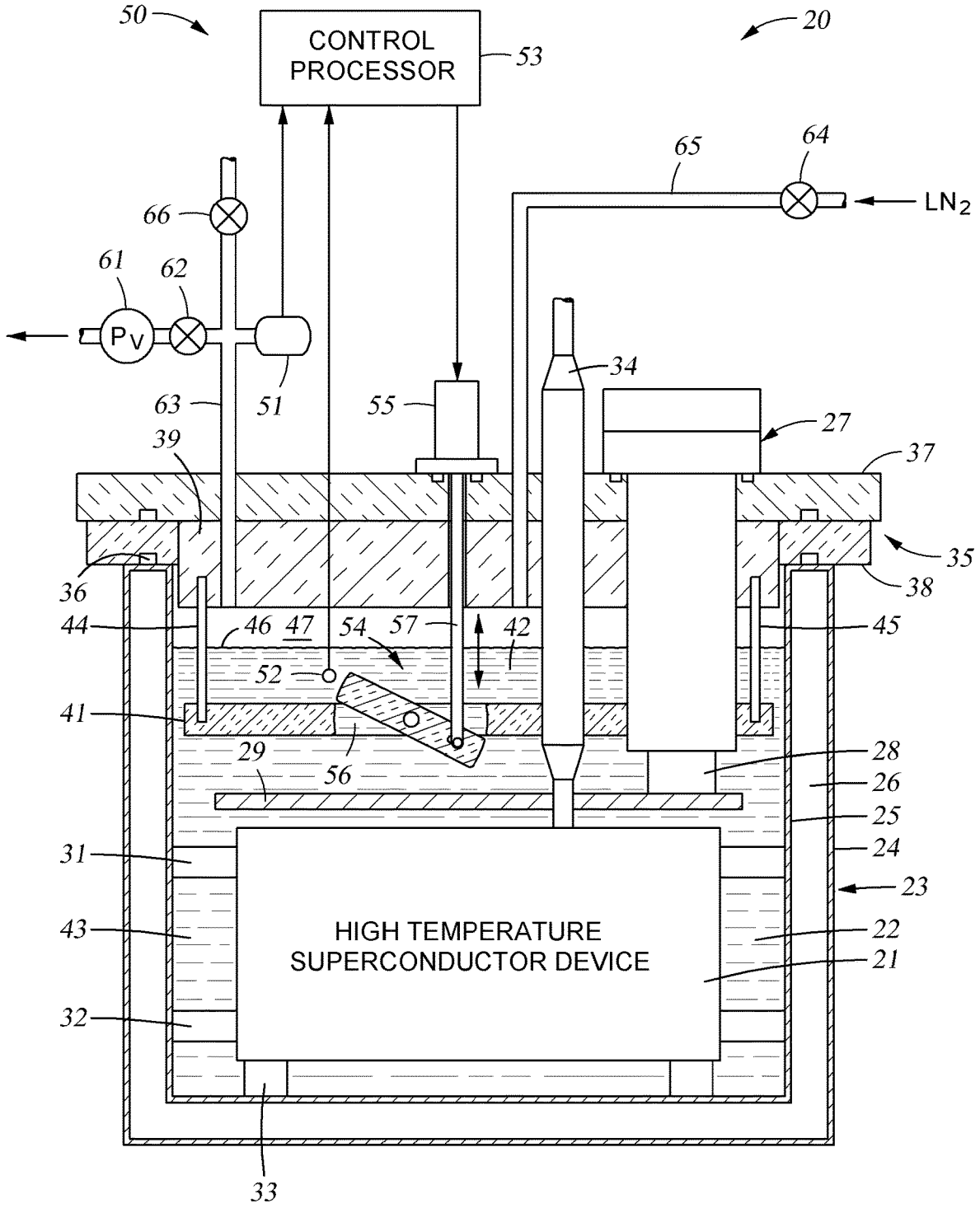
FIG. 1 is a schematic diagram of a first apparatus including a high temperature superconducting device immersed in liquid cryogen.

While the invention is susceptible to various modifications and alternative forms, specific embodiments thereof have been shown in the drawings and will be described in detail. It should be understood, however, that it is not intended to limit the invention to the particular forms shown, but on the contrary, the intention is to cover all modifications, equivalents, and alternatives falling within the scope of the invention as defined by the appended claims.

MODES FOR CARRYING OUT THE INVENTION

With reference to FIG. 1, there is shown a high temperature superconducting apparatus 20 including a high temperature superconductor (HTS) device 21 immersed in liquid cryogen 22. For example, the liquid cryogen is liquid nitrogen, the HTS of the device 21 includes windings of Bi2223 or REBCO HTS, and the device 21 is a superconducting magnet, a superconducting fault current limiter, or a superconducting energy storage inductor.

In FIG. 1, the liquid cryogen 22 is contained in a thermally insulated vessel 23 functioning as a cryostat. In this example, the vessel 23 is cylindrical and has an outer wall 24, and inner wall 25 jointed to the outer wall at the top of the vessel, and an evacuated space 26 between the inner and outer walls. For example, the inner wall 24 and the outer wall 25 are made of stainless steel.

For the reasons discussed above, it is desired to cool the HTS device 21 to a temperature below the boiling point of the liquid cryogen at the pressure within the vessel 23. In other words, it is desired for the HTS device to be "sub-cooled" within the bath of liquid cryogen in the vessel 23. For example, when liquid nitrogen is used as the liquid cryogen, the HTS device is sub-cooled to a temperature below seventy degrees Kelvin. For sub-cooling the HTS device, the apparatus 20 includes a cryogenic refrigerator 27 mounted to the vessel 23 and having a cold head 28 thermally coupled to the HTS device 21 for maintaining the high temperature superconductor below its transition temperature for superconductivity.

For example, the cryogenic refrigerator 27 is a Gifford-McMahon (GM) cryogenic refrigerator or a pulse tube refrigerator (PTR), and the cold head 28 is thermally coupled to the to the HTS device 21 via a heat conduction plate 29 immersed in the liquid cryogen 22 and disposed above the HTS device 21. The heat conduction plate 29 is made of thermally conductive material such as oxygen-free copper. In this example, there is a gap between the HTS device 21 and the inner wall 25 of the vessel 23 to promote heat transfer from the HTS device 21 to the conduction plate 29 via the liquid cryogen 22 surrounding the high temperature superconductor device. The gap is defined by mounting rings or spacers 31, 32, 33 between the HTS device 21 and the inner wall 25. For example, the mounting rings or spacers 31, 32, 33 are made of glass reinforced plastic such as epoxy-fiberglass.

When liquid nitrogen is used as the liquid cryogen for cooling the HTS device 21, a most suitable temperature for the liquid nitrogen is 64 to 65 degrees Kelvin in order to avoid complications that might result from freezing the liquid nitrogen on the cold head 28. The temperature can be maintained at 64 to 65 degrees Kelvin by cycling the cryogenic refrigerator 27 on and off under control of a thermostat.

In the example of FIG. 1, the HTS device is coupled by an assembly of current leads 34 extending from the HTS device 21 to the environment external to the vessel 23. For example, the assembly 34 includes electrically insulated copper conductors wrapped with thermal insulation such as aluminized plastic film. However, the apparatus 20 of FIG. 1 could also be used for cooling a HTS device that would not need or use such current leads, such as a superconducting magnet operated in a persistent mode, or a superconductor acting as a magnetic shield or eddy current mirror, for example, in a magnetic bearing.

Current leads can introduce a significant variable heat influx into the liquid cryogen depending on the electrical load of the HTS device 21, and therefore they should be thermally insulated where they pass from the thermal insulation 39 and into and through the liquid cryogen 22. Some heat may be released into the liquid cryogen in the upper compartment 42 without disturbing the control of the temperature of the liquid cryogen in the upper compartment, but the control of this temperature (and hence control of the pressure in the vessel 25) is made much simpler by minimizing the variability of the heat flux into the liquid cryogen in the upper compartment 42.

In the apparatus 20, it is desired to maintain a pressure in the vessel 23 of at least atmospheric pressure to prevent water vapor and condensable gas from the atmosphere from freezing or condensing in the vessel. For example, the gas pressure is maintained in the range of zero to two kPa above atmospheric pressure. Therefore the apparatus 20 is provided with a cover 35 having an O-ring seal 36 seating upon the top of the vessel 23. Operation at a pressure within the range of zero to two kPa simplifies the construction of such a seal and similar seals for other components that penetrate the cover 35. Moreover, operation in such pressure range at slightly above atmospheric pressure (for example, at one kPa above atmospheric pressure) would permit these components to be replaced during operation of the apparatus with a minimal loss of cryogen that would flow out to the atmosphere to prevent an inflow of water vapor and other atmospheric contamination.

As shown in FIG. 1, the cover 35 includes a top plate 37, a lower ring 38, and a disc 39 of thermal insulation that fits inside the vessel 23. For example, the top plate 36 and the ring 37 are made of glass reinforced plastic such as G-10 epoxy fiberglass, and the disk 38 is made of foam plastic such as polyurethane or polystyrene foam. Various penetrations into the vessel 23 are made through the top plate 37 and have seals engaging the top plate so that the penetrations and seals are kept well above the surface of the liquid cryogen and are kept close to ambient temperature.

In the apparatus 20, it is also desired to maintain a pressure in the vessel 23 of at least atmospheric pressure without boiling off the liquid cryogen 22 and without the introduction of non-condensable gas such as helium. This would avoid a need to replenish or recycle the cryogen, or regulate the pressure of the non-condensable gas. In the apparatus 20, a pressure of at least atmospheric pressure is maintained in the vessel 23 by disposing a thermal insulation barrier 41 in the vessel to define an upper compartment 42 within the vessel above the barrier and a lower compartment 43 within the vessel below the barrier and having a passage interconnecting the upper compartment to the lower compartment to allow pressure equalization between the upper compartment and the lower compartment, and maintaining a temperature of the liquid cryogen in the upper compartment at a temperature of at least a boiling point of the liquid cryogen at atmospheric pressure when the lower compartment and at least a portion of the upper compartment are filled with the liquid cryogen.

In the apparatus 20, the thermal insulation barrier 41 is a disk having a diameter slightly less than the inner diameter of the inner wall 25 of the vessel 23 in order to provide a passage to allow pressure equalization between the upper compartment and the lower compartment and to allow easy assembly of the thermal insulation barrier into the vessel. The gaps at the barrier edges can be up to a few millimeters wide. The thermal insulation barrier 41 also does not need to have a very close fit to penetrations through the barrier, such as penetrations for the cold head 28 of the cryogenic refrigerator 27 and for the current lead assembly 34. The ratio of the gap width to gap depth can be small so that the liquid cryogen in the gap is relatively undisturbed by circulation of the liquid cryogen in the lower compartment 43 and tends to be stably stratified. The thermal conductivity of liquid nitrogen under these conditions is about 0.15 W/m·K. The effective depth of the stratified column of cryogen within these gaps could be increased if required by fitting a lip or skirt extending down into the lower compartment 43.

The thermal insulation barrier 41 is attached to and suspended from the cover 35 by a number of rods or tubes 44, 45. For example, the thermal insulation barrier 41 is made of rigid plastic foam such as polyurethane or polystyrene foam, and the rods or tubes 44, 45 are made of glass reinforced plastic such as epoxy fiberglass. For example, the spacing between the bottom of the thermal insulation 39 and the top of the thermal barrier 41 is between 5 and 100 mm, such as 20 mm. The upper compartment 42 is partially filled with the liquid cryogen 22 so that the liquid cryogen has a surface layer 46 in the upper compartment, and there also is a layer 47 of cryogen gas in the upper compartment above the surface layer 46. For example, the surface layer 47 is midway between the bottom of the thermal insulation 39 and the top of the thermal barrier 41. The surface layer 47 could be raised or lowered from the midway level by adding or removing cryogen in order to increase or decrease the thermal time constant to a value more appropriate for regulation of the cryogen pressure.

In one example, the thermal barrier 41 is a polyurethane or polystyrene foam sheet between 5 to 10 mm thick sandwiched between thin sheets of G-10 epoxy fiberglass for added strength. These materials will have good dielectric strength for use near high voltage current leads and connections and HTS windings.

The apparatus 20 has a temperature controller 50 for maintaining the liquid cryogen in the upper compartment 42 at a temperature of at least a boiling point of the liquid cryogen at atmospheric pressure. In this example, the temperature controller 50 is an electronic system including a gas pressure sensor 51 for sensing gas pressure in the vessel 23, a temperature sensor 52 sensing temperature of the liquid cryogen in the upper compartment, a control processor 53 electronically connected to the gas pressure sensor 51 and the temperature sensor, a heat flow regulator 54 for regulating a flow of heat from the upper compartment 42 to the lower compartment 43, and an actuator 55 mechanically coupled to the heat flow regulator 54 and electronically connected to the control processor 53 so that the control processor may regulate the flow of heat from the upper compartment 42 to the lower compartment in response to the sensed pressure in the vessel or the sensed temperature of the liquid cryogen in the upper compartment 42.

For example, the pressure sensor 51 is a differential pressure sensor sensing the difference between the pressure in the vessel 23 and atmospheric pressure. The temperature sensor 52 is a silicon diode immersed in the liquid cryogen 22 in the upper chamber 42 and sensing absolute temperature of the liquid cryogen. The control processor 53 is a microcontroller or general purpose digital computer programmed to read the differential gas pressure from the pressure sensor 51 and to read the absolute temperature from the temperature sensor 53 and to adjust the actuator 55 to maintain the differential gas pressure at a gas pressure setpoint or to maintain the absolute temperature at a temperature setpoint. A specific example of such programming is described below with reference to FIG. 2.

In FIG. 1, the heat flow regulator 54 provides an adjustable opening 56 in the thermal barrier, and the area of the opening is increased to increase the flow of heat from the upper compartment 42 to the lower compartment 43, and the area of the opening is decreased to decrease the flow of heat from the upper compartment 42 to the lower compartment 43. In this specific example, the heat flow regulator 54 is a butterfly valve or louver that is opened and closed by the actuator 55, and the actuator is a linear actuator mounted on top of the cover 35 and having a vertical shaft 57 descending to the butterfly valve or louver. The adjustable opening 56 could be provided by other kinds of valves or vents such as sliding flaps or flaps that would be opened or closed by rotation of a vertical shaft.

Figure 3:
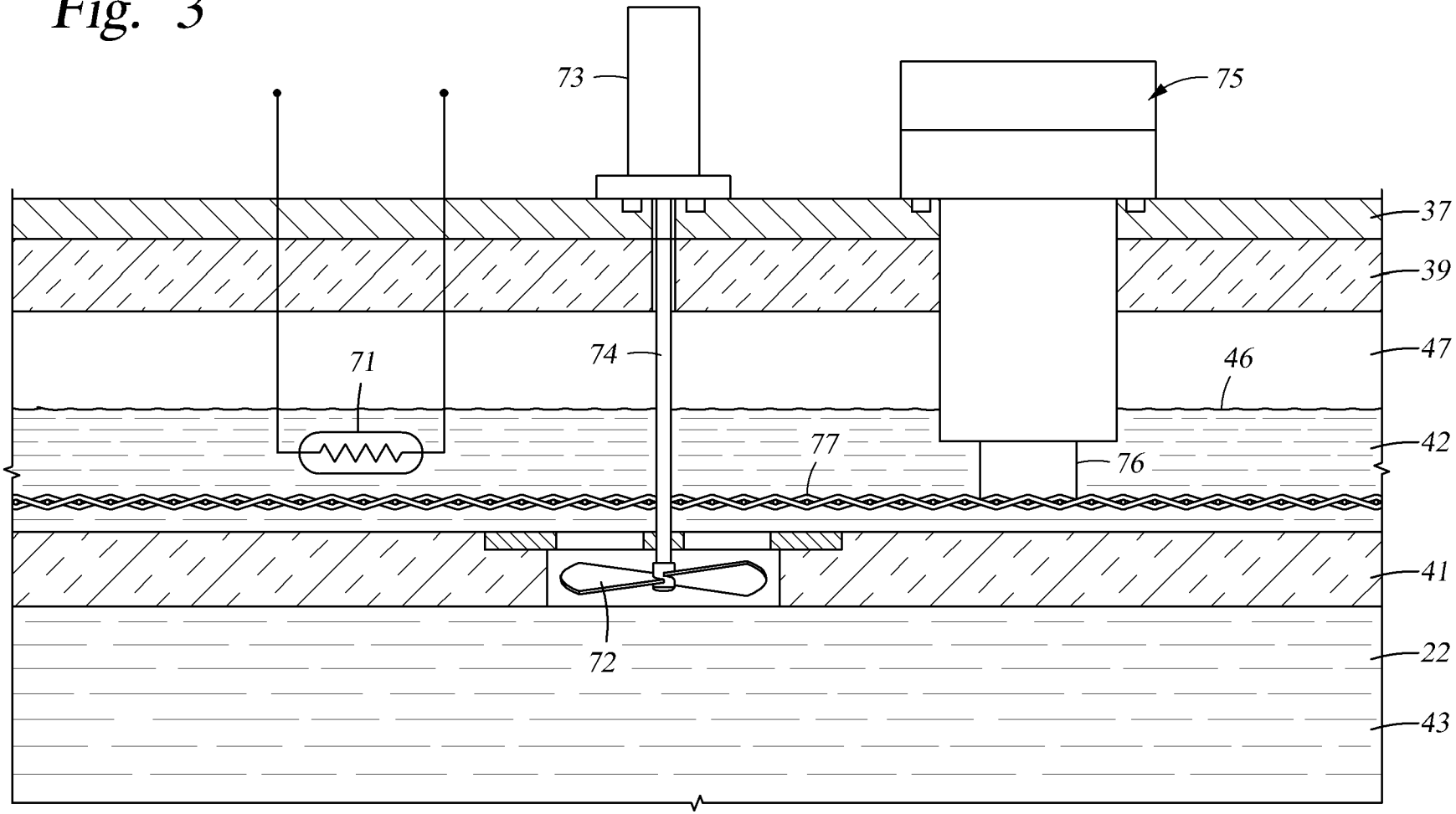
FIG. 3 is a schematic diagram showing alternative devices substituted for the butterfly valve or louver shown in FIG. 1.

The transfer of heat by such valves or vents is by free mixing of the liquid cryogen from the lower compartment 43 with the liquid cryogen in the upper compartment 42. The rate of heat transfer will depend on the velocity of cryogen circulation in the lower compartment 43, the size of the opening, the ratio of the vertical to horizontal extent of the opening, and features of the valves or vents such as blades that direct a flow of the liquid cryogen to produce turbulence and mixing. As shown and described further below with reference to FIG. 5, the circulation of the liquid cryogen in the lower compartment can be augmented by placement and orientation of a cold head heat exchanger with respect to heat sources such as current leads and heat leaks through the walls of the cryostat vessel. The circulation and mixing of the liquid cryogen can also be augmented by a pump or stirrer, as shown in FIG. 3 and further described below.

The apparatus 20 also has some components for filling the vessel 23 with the liquid cryogen, such as liquid nitrogen ($LN_2$). First, a vacuum pump 61 is turned on and a valve 62 is opened to purge the vessel 23 of air and water vapor through a purge line 63 from the upper compartment 42. Then the cryogenic refrigerator 27 is turned on to cool the heat conduction plate 29 below the boiling point of the liquid cryogen. Then a valve 64 is opened to admit liquid cryogen into the upper compartment 42 though a fill line 65 until the lower compartment 43 is entirely filled with the liquid cryogen and the upper compartment 42 is at least partially filled with the liquid cryogen. Then the valve 64 is closed, the purge valve 62 is closed, and the vacuum pump 61 is turned off. Then the temperature controller 50 is turned on. Once the pressure in the vessel 23 has stabilized to a value of at least atmospheric pressure, current is applied through the current lead assembly 34 to the HTS device 21.

Venting of cryogen boil-off should not occur unless the pressure regulation is inoperative or there is a leak or there is an uncontrolled quench of the HTS device. If the pressure in the vessel 23 reaches a safety limit, then a pressure relief valve 66 opens automatically. Burst disks could also be used for pressure relief. If the pressure relief valve 66 were to fail and the pressure would rise further and overcome a force keeping the cover 35 on the vessel 23, then the cover would disengage from the vessel to relieve the pressure.

Depending on the nature of the HTS device 21, additional components may be added to the apparatus 20 of FIG. 1. These additional components could be added to accommodate high voltage operation, or to accommodate gas bubbles caused by a quench, for example a controlled quench due to a fault current if the HTS device 21 were a fault current limiter. Electrically insulating dielectric barriers may be incorporated to deflect streams of bubbles of boiling liquid nitrogen away from regions of the HTS device 21 with a high potential for dielectric breakdown, or to promote collection and mixing of liquid and gas phase to condense gas bubbles. Electrically earthed structures such as submerged grids may be incorporated to electrically isolate high voltage components from the cryogenic refrigerator 27 and the heat conduction plate 29.

Figure 2:
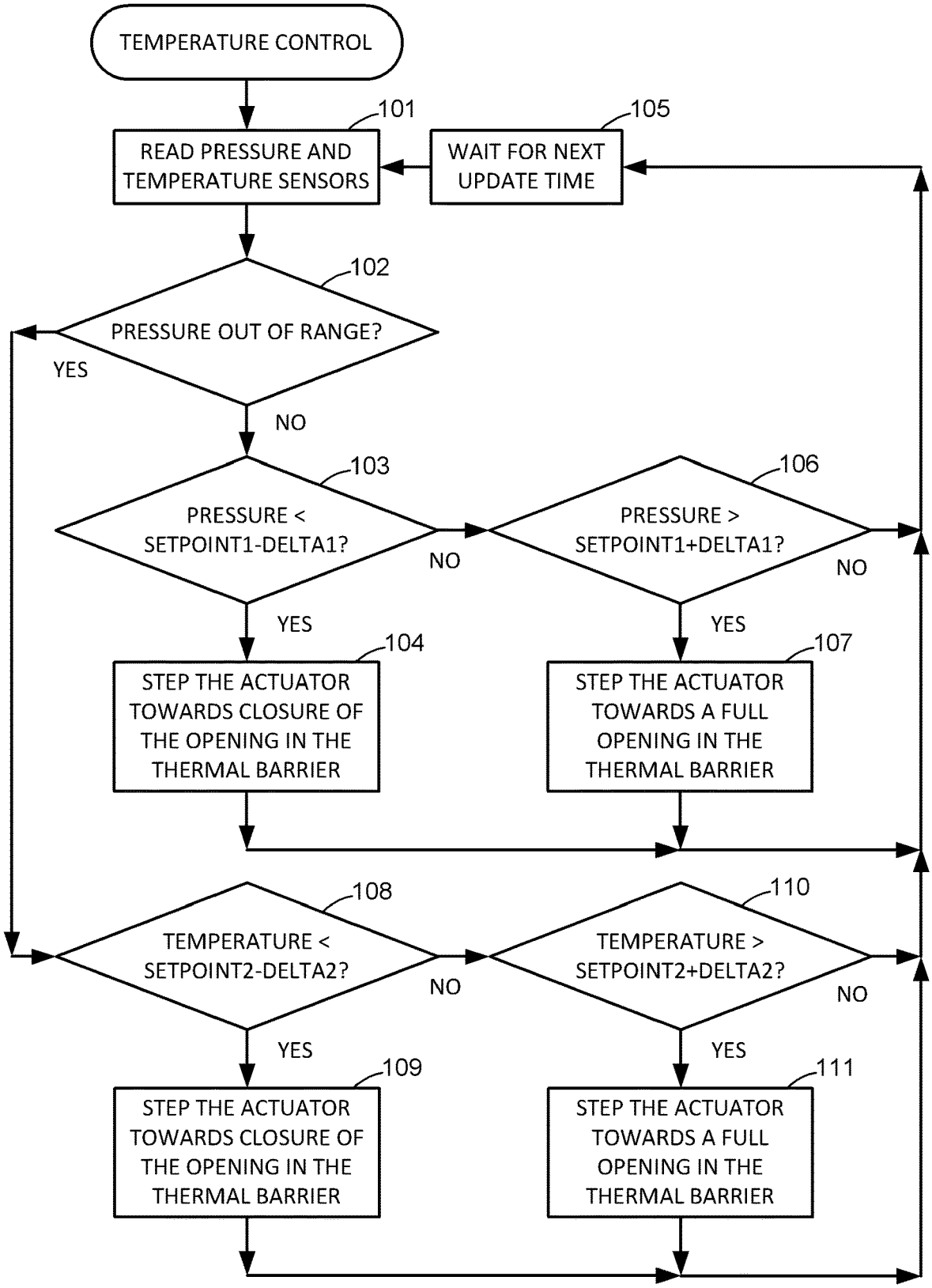
FIG. 2 is a flowchart of a temperature control procedure used in the apparatus of FIG. 1.

FIG. 2 shows a specific example of a basic temperature control procedure for the control processor (53 in FIG. 1). This basic control procedure is suitable for a HTS device and current lead assembly that provide a relatively constant heat load upon the cryogenic refrigerator. Techniques for handling variable heat loads will be described further below with reference to FIGS. 3-5.

The control procedure in FIG. 2 uses pressure readings from the pressure sensor (51 in FIG. 1) or temperature readings from the temperature sensor (52 in FIG. 1) to control the temperature of the liquid cryogen in the upper compartment (42 in FIG. 1) so that the temperature is at least the boiling point of the liquid cryogen at atmospheric pressure. Absent a leak in the sealing of the upper compartment from the external environment at atmospheric pressure, the pressure reading is more sensitive than the temperature reading for a comparison of the temperature of the liquid cryogen in the upper compartment to the boiling point of the liquid cryogen at atmospheric pressure. Therefore the pressure reading is used for control of the temperature unless the pressure reading is outside of a normal range indicating a significant likelihood of a leak or a failure of the pressure sensor. If the pressure reading is outside of the normal range, then the temperature reading is used for control of the temperature.

In a first box 101, the control processor reads the gas pressure from the pressure sensor (51 in FIG. 1) and reads the temperature from the temperature sensor (52 in FIG. 1). In box 102, if the gas pressure reading is within a normal range, then execution continues to box 103. For example, the temperature controller has a pressure setpoint of 1.1 kPa above atmospheric pressure, and a normal pressure range from 0.2 kPa above atmospheric pressure to 2.0 kPa above atmospheric pressure, so that a pressure of less than 0.2 kPa above atmospheric pressure is indicative of a leak.

In box 103, if the pressure reading is less than the pressure setpoint (SETPOINT1) minus a noise margin (DELTA1), then execution continues to box 104 to step the actuator towards closure of the opening in the thermal barrier. For example, the noise margin (DELTA1) is 0.05 kPa. After box 104, execution continues to box 105 to wait for a next update time. For example, there is a delay in box 105 on the order of about one second. In general, the delay is selected so that the time for adjustment of the opening, from a fully open state to a fully closed state, is much greater than the response time of the pressure sensor to the change in the opening.

In box 103, if the pressure reading is not less than the pressure setpoint (SETPOINT1) minus the noise margin (DELTA1), then execution branches to box 106. In box 106, if the pressure reading is greater than the pressure setpoint (SETPOINT1) plus the noise margin (DELTA1), then execution continues to box 107 to step the actuator towards a full opening in the thermal barrier. Execution continues from box 107 to box 105. Execution also continues from box 106 to box 105 if the pressure reading is not greater than the pressure setpoint (SETPOINT1) plus the noise margin (DELTA1).

In box 102, if the pressure reading is out of range, then execution branches to box 108. In box 108, if the temperature reading is less than a temperature setpoint (SETPOINT2) minus a noise margin (DELTA2), then execution continues to step 109 to step the actuator towards closure of the opening in the thermal barrier. The temperature setpoint corresponds to the pressure setpoint in accordance with the temperature-pressure characteristic of the liquid cryogen, and the noise margin (DELTA2) is the noise level of the temperature sensor. After box 109, execution continues to box 105 to wait for the next update time.

In box 108, if the temperature reading is not less than the temperature setpoint (SETPOINT2) minus the noise margin (DELTA2), then execution branches to box 110. In box 110, if the temperature is greater than the temperature setpoint (SETPOINT2) plus the noise margin (DELTA2), then execution continues to box 111 to step the actuator towards a full opening in the thermal barrier. Execution continues from box 111 to box 105. Execution also continues from box 110 to box 105 if the temperature is not greater than the temperature setpoint (SETPOINT2) plus the noise margin (DELTA2).

FIG. 3 shows alternative devices that could be added to the apparatus 20 in FIG. 1 for more aggressive control of the temperature in the upper compartment 42. A resistive electrical heater 71 could be used to rapidly heat the liquid cryogen in the upper compartment 42. A pump or stirrer 72 such as a turbine could rapidly cool the liquid cryogen in the upper compartment 42 by pumping or stirring colder liquid cryogen from the lower compartment 43 into the upper compartment so that it becomes mixed with the liquid cryogen in the upper compartment. In the example of FIG. 3, the pump or stirrer 73 is driven by a motor 73 mounted on the upper plate 37 and having a shaft 74 secured to the pump or stirrer 72. For a large apparatus, another cryogenic refrigerator 75 could be mounted to the upper plate 37 and dedicated to cooling the liquid cryogen in the upper compartment. For example, the cryogenic refrigerator 75 has a cold head 76 in the upper compartment and a heat conduction grid 77 secured to the cold head for collecting heat from the liquid cryogen in the upper compartment 42.

In another example, a plunger instead of a stirrer could be used as a mixer to control the temperature of the liquid cryogen in the upper compartment 42 by mixing liquid cryogen from the lower compartment with liquid cryogen in the upper compartment. For example, a plunger (similar to the valve member 82 shown in FIG. 4) could be driven selectively up and down by a linear actuator (similar to the linear actuator 83 in FIG. 4) for rapid cooling of the liquid cryogen in the upper compartment 42.

The alternative devices 71, 72, and 75 have the ability to deliver or remove heat from the liquid cryogen in the upper compartment 42 at controlled variable rate. Therefore they are well suited for control of the temperature of the liquid cryogen in the upper compartment 42 in response to the pressure or temperature readings by using a conventional proportional-integral-differential (PID) controller. Such a PID controller could also respond to changes in current through the current lead assembly 34 by predicting changes in heat loading that would be produced by the changes in current, and adjusting the heat control mechanism to effect a change in heating or cooling that would counterbalance the change in heating from the current lead assembly.

The resistive heater 71 has the advantage that it is relatively inexpensive and compact, so that it is practical to distribute a multiplicity of the resistive heaters uniformly within the first compartment or to concentrate them at colder regions of the first compartment.

The cryogenic refrigerator 75 has the disadvantage that it is relatively expensive in comparison to the resistive heater 71 or a controlled opening in the thermal barrier 41. Also a conventional GM or pulse tube cryogenic refrigerator should be larger than a certain size to have a high cooling efficiency. Therefore the cryogenic refrigerator 75 would be best suited for a large apparatus where the cooling capacity of a conventional cryogenic refrigerator having a high cooling efficiency could accommodate the variations in heat flow from the first compartment that would be needed to maintain the pressure or temperature at the pressure setpoint or temperature setpoint. In this case the cryogenic refrigerator 75 would have the advantage of providing the temperature control with high energy efficiency.

FIG. 4 shows another mechanism 80 for controlling of the temperature in the upper compartment 42 in response to the pressure in the vessel. In this case the mechanism 80 is entirely mechanical so that it would be operative when there would be a loss of electrical power. In this example an opening 81 in the thermal barrier 41 is produced when a valve member 82 is raised from the thermal barrier by a bellows or membrane actuator 83 powered by the gas pressure in the vessel. Such a bellows or membrane actuator could also be used to operate the butterfly valve or louver 54 as shown in FIG. 1.

Sub-cooling of HTS transformer windings presents a further challenge of heat loading from hysteresis loss in the transformer cores. The transformer cores are comprised of silicon steel laminations that carry magnetic flux linking the HTS windings. The transformer cores themselves are not cooled to cryogenic temperature, but heat from the cores causes significant heat loading upon the cryogenic components because there is a tradeoff between power consumed by the cryogenic refrigerator to remove heat conducted from the cores, and power loss due to hysteresis loss in the cores. The heat conduction from the cores to the HTS windings could be reduced by increasing the thickness of thermal insulation between the cores and the windings, but then the cores would also need to be increased in size to accommodate the increased thickness of the thermal insulation, and this increase in size would increase the hysteresis loss in the cores. Therefore the thickness of the thermal insulation around the cores is less than that the thickness of the thermal insulation used at the periphery of the cryostat vessel.

A further constraint on transformer design is that electrically conductive components within the cryogenic space must be designed to minimize eddy currents induced by stray magnetic fields. This means for example that the high purity copper or aluminium parts of heat exchangers should be situated where magnetic fields are low, and subdivided where appropriate to limit the dimensions transverse to the local field. Copper bus work and terminations should be designed to minimize eddy currents Any electrically conductive components that encircle transformer cores apart from the windings need to be interrupted by an electrically insulating section or replaced by insulating materials, for example fiber glass composites.

Figure 6:
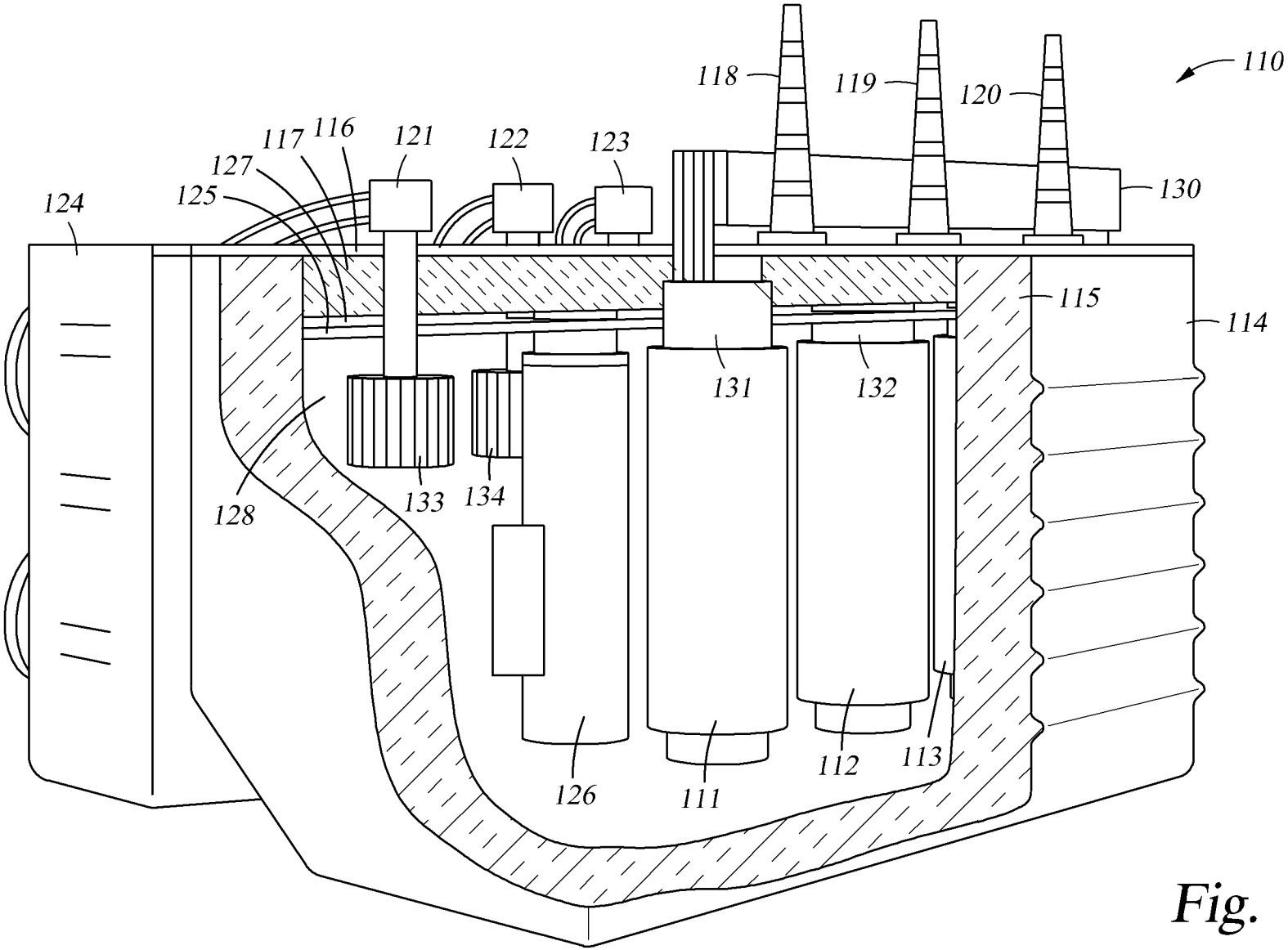
FIG. 6 is a perspective view of a three-phase superconducting power transformer having high temperature superconductor coils immersed in liquid cryogen and using at least one of the features introduced in FIGS. 1 to 5 for maintaining a pressure of at least atmospheric pressure in the liquid cryogen.

FIG. 5 shows a schematic diagram of an HTS transformer core 91 and a single HTS winding 92 of the transformer in a cryostat vessel 93. The proportions of the parts have been distorted for illustrating challenges associated with sub-cooling of the HTS winding, and a practical example without this distortion is shown in FIG. 6 and will be described further below. The vessel 93 includes a thermally insulating sleeve 94 between the core 91 and the liquid cryogen 95 in the vessel 93, so that the core 91 is at atmospheric pressure and near the temperature of the environment external to the vessel 93.

A cryogenic refrigerator 96 has a cold head 97 and a finned heat sink 98 secured to the cold head for absorbing heat from the liquid cryogen 95. Heat is conducted from the core 91 and from a current lead assembly 100 by convection of the liquid cryogen 95, and the liquid cryogen 95 sub-cools the HTS windings 92 well below the boiling point of the liquid cryogen. A thermal barrier 99 divides the interior of the vessel 93 into an upper compartment 101 and a lower compartment 102. The lower compartment 102 is filled with the liquid cryogen 95 and the HTS windings 92 and the heat sink 98 are immersed in the liquid cryogen in the lower compartment. The upper compartment 101 is partially filled with the liquid cryogen 95, and the temperature of the liquid cryogen in the upper compartment 101 is regulated by an adjustable opening 103 in the thermal barrier 99 in order to maintain a pressure in the vessel of at least atmospheric pressure. In this example, the convection of the liquid cryogen 95 provides a motive force for mixing of the colder cryogen from the lower compartment 102 with the warmer cryogen in the upper compartment 101 when the adjustable opening 103 is adjusted to permit a flow of liquid cryogen from the upper compartment 101 to the lower compartment 102.

FIG. 6 is a perspective view of a three-phase superconducting power transformer 110. For example, the transformer 110 is rated at 40 MVA and has a height of about two meters. The transformer 110 has HTS windings 111, 112, 113 immersed in sub-cooled liquid cryogen and using at least one of the features introduced in FIGS. 1 to 5 for maintaining a pressure above atmospheric pressure in the liquid cryogen. The transformer 110 has a vessel 114 manufactured from fiber glass composite or similar electrically insulating material or possibly metal with appropriate insulating sections to avoid an electrical circuit surrounding the cores. The vessel 114 is lined with plastic foam insulation 115 on the bottom and sides, and the vessel has a cover 116 on top lined with plastic foam insulation 117. Plastic foam insulation such as polyurethane foam or polystyrene foam provides adequate thermal insulation of the walls of the vessel 114 at modest cost compared to vacuum construction provided that a sufficient thickness of foam can be accommodated.

The transformer 110 has a ferromagnetic core 130 having a respective core penetration thorough each of the three HTS coils 111, 112, 113 and through the top and the bottom of the vessel 114. For example, the ferromagnetic core 130 is made of laminated silicon steel sheets. The core penetrations are thermally insulated from the cryogen by vacuum insulated sleeves 131, 132 extending up from the bottom of the vessel 114.

In contrast to the examples of FIGS. 1-5, FIG. 6 shows a minimum of "head space" from the top of the HTS windings 111, 112, 113 to the bottom of the plastic foam insulation 117. In practice, it is desired to minimize this head space in order to reduce the height of the core 130 so as to reduce core loss and reduce the weight of the core 130.

Current at a high voltage is supplied to the HTS windings 111, 112, 113 through high voltage bushings 118, 119, 120. The HTS windings 111, 112, 113 and a tap changer 126 are sub-cooled by three cryogenic refrigerators 121, 122, and 113. The cryogenic refrigerators 111, 112, 113 are powered by a rack 124 of fan-cooled gas compressors mounted to the rear of the vessel 114. In order to reduce the head space and to avoid excessive eddy current losses, a thermal conduction plate is not used above the HTS windings for thermal coupling of the cold heads of the cryogenic refrigerators 121, 122, 123, and instead thermal coupling is provided by convection of the liquid cryogen from thermally conductive finned heat sinks 133, 134 mounted to the cold heads. The heat sinks 133, 134 are preferably fabricated from high-purity copper or aluminum to minimize temperature differentials resulting from heat fluxes of about 500 watts per cryogenic refrigerator.

Although the cryogenic refrigerators 121, 122, 123 are shown mounted to the top of the vessel 114, they could be mounted instead to the side walls of the vessel. The cryogenic refrigerators could also be mounted on a separate vessel, vacuum or foam insulated, and heat transfer from the cold head heat exchangers could be effected by circulation of a cryogen within a closed circuit or by a heat pipe.

A thermal barrier 125 divides the interior of the vessel 114 into an upper compartment 127 and a lower compartment 128. The lower compartment 128 is filled with the liquid cryogen and the upper compartment 129 is at least partially filled with the liquid cryogen. A pressure of at least atmospheric pressure is maintained in the vessel 114 by regulation of the temperature of the liquid cryogen in the upper compartment 116 using one or more of the techniques describe above with reference to FIGS. 1-5.

For the case of a high voltage HTS transformer, it is not clear that the advantages of operating at a pressure substantially elevated from atmospheric pressure outweigh the disadvantages. A cryostat operated at no more than a few kPa above ambient pressure has the advantage that it need not be designed and constructed to withstand high pressure. On the other hand, some minimal positive pressure ensures that the cryostat will not be contaminated from the surrounding air in the event of a leak. It is also possible that maintenance procedures such as exchanging a cold head or sensors could be carried out without closing down the device or exposing it to air using appropriate glove-box type chambers and procedures.

A number of studies have demonstrated reduced breakdown voltages in liquid nitrogen in the presence of bubbles. Sauers et al., cited above, for example, shows that in liquid nitrogen sub-cooled to 73 K at 1 bar pressure the breakdown strength drops from about 25 kV rms/mm to about half that value above a critical flux of thermally generated bubbles.

The supposed advantages of reduced breakdown voltage at elevated pressure are in practice quite limited. This is because devices such as fault current limiters and transformers have to be engineered to survive short circuits without damage. There are only limited options for avoiding boiling cryogen during a short circuit, regardless of operating pressure.

The critical current of the device could exceed the short circuit current—by definition not an option for a resistive fault current limiter, and far too expensive for transformers at foreseeable conductor prices.

Alternatively the device could be disconnected from the high voltage supply before the conductor temperature reaches a temperature at which boiling is nucleated. This is difficult. Commercially available 2G conductor 0.1 mm thick with 0.04 mm thick copper stabilizer will heat from liquid nitrogen temperature to room temperature in under 0.2 s in a typical short circuit. Reducing the temperature rise to about $1/10^{th}$ of this would require conductor with about 20 times the thermal mass, and still require very fast disconnection of the device. This automatic disconnection is not acceptable in most transformer applications, because the protection system should isolate the fault on the bus downstream from the transformer without interrupting power to other loads on the bus. Therefore in the usual case it is impractical to avoid boiling in the windings during a fault. This means that a designer should not rely on the higher breakdown voltage in bubble-free liquid nitrogen, and instead the designer should design for safe operation in boiling liquid cryogen.

Following is an example of the design of a thermal insulation barrier for a cryostat using sub-cooled liquid nitrogen at a temperature of 65 degrees Kelvin. Assume a design operating pressure about 1% in excess of atmospheric pressure controlled to about ±0.5% of atmospheric pressure, i.e. a gauge pressure of +1.0±0.5 kPa. This means that the temperature of the surface cryogen exceeds the boiling point of liquid nitrogen at atmospheric pressure by just $\Delta T \sim +0.08 \pm 0.04$ K. To maintain this temperature, the heat flux though the lid insulation should balance the heat flux though the insulated barrier to the sub-cooled compartment below. In a large cryostat the heat flux through the sides of the surface compartment and through gaps in the lid insulation and barrier insulation will be a small fraction of the total. Assuming a lid insulation thickness of 100 mm of polyurethane foam with a thermal conductivity of 0.03 W/m·K, the heat flux across the 218 K temperature jump from ambient at 295 K to the surface cryogen space at 77 K is 65 $W/m^2$. To maintain a 12 K temperature difference across the insulating barrier we require just 12/218=5.5% of the thickness of the lid insulation, assuming the thermal conductivity of the foam does not vary with temperature. In fact the thermal conductivity of polyurethane foam at liquid nitrogen temperature may be as little as ⅓ of the value of room temperature, i.e. around 0.01 W/m·K, so the foam thickness required for the barrier may be only a few millimeters. For comparison the thermal conductivity of stratified liquid nitrogen at around 77 K is 0.15 W/m·K and in stratified nitrogen gas at 1 atm is proportional to temperature, and around 0.01 W/m·K at 100 K, not very different from polyurethane foam.

If the heat flux through the lid is 65 $W/m^2$, the vertical thermal gradient within the surface cryogen zone will be around 0.4 K/mm. For a cryogen depth above the insulating barrier zone of 10 mm this is a third of the desired temperature difference between sub-cooled cryogen and surface cryogen, and the barrier insulation thickness could be reduced accordingly. In practice the balance of lid insulation, surface cryogen depth, and barrier insulation would need to be tailored for a particular application. In transformer applications, for example, the cost of adding headspace to the cryostat in terms of increased cryostat and iron core height will at some point outweigh the reduced cryostat losses resulting from increased insulation thickness.

To maintain the temperature in the sub-cooled zone in the desired operating range of the HTS device, the cryogenic refrigerator will need to be cycled on and off to match the average thermal load from the device and cryostat. In the case of multiple cryogenic refrigerators, the load would be shared between refrigerators to minimize the number of on-off cycles for individual refrigerators. It is desirable to size the cryostat to have a large mass of cryogen in relation to the rated load, or equivalently cooling power, of the equipment. A cryogen mass of 1 kg/watt of cooling power is a reasonable ratio. The specific heat of liquid nitrogen is 2040 J/kg·K, so that at 1 kg/W, the thermal inertia of the system is such that with a full thermal load and the cryogenic refrigerators off it will take 2040 seconds, or 34 minutes to warm the sub-cooled volume by 1 K. Since the performance of typical HTS conductors drops off rapidly with increasing temperature reasonably tight control of the maximum temperature in the sub-cooled zone is desirable.

If the operating temperature is set at 65±1 K, then the temperature drop across the insulating barrier will vary by less than ±10%. Given that the thermal conductivity of liquid nitrogen is around a factor of 10 higher than that of polyurethane foam, opening just a few percent of the barrier area for thermal conduction through the liquid phase will achieve the required variation of total thermal conductance to regulate the surface zone temperature. Mixing of the sub-cooled and surface cryogen will further increase the heat transfer. In addition, the thermal time constant of the liquid nitrogen in the surface compartment will damp fluctuations in the temperature of the sub-cooled liquid nitrogen even without adjustment of the thermal transfer between the upper and lower compartments.

In view of the above, a thermally insulated vessel contains a thermal insulation barrier defining an upper compartment in the vessel above the barrier and a lower compartment in the vessel below the barrier. The compartments are interconnected by a passage to allow pressure equalization. High temperature superconductor is mounted within the lower compartment for immersion in the liquid cryogen. A cryogenic refrigerator has a cold head thermally coupled to the high temperature superconductor for maintaining the high temperature superconductor below a superconductive transition temperature. A temperature controller maintains a temperature of the liquid cryogen in the upper compartment at a temperature of at least a boiling point of the liquid cryogen at atmospheric pressure when the lower compartment and at least a portion of the upper compartment are filled with the liquid cryogen. For example, the liquid cryogen is liquid nitrogen at 64 to 65 degrees Kelvin in the lower compartment, and the temperature of the liquid nitrogen in the upper compartment is regulated for a pressure in the range of zero to two kPa above atmospheric pressure. Operation of the high temperature superconductor at the lower temperature is advantageous because the performance of the high temperature superconductor is substantially improved. Operation of at a pressure of at least atmospheric pressure eliminates boiling of the liquid cryogen at the high temperature superconductor during normal operation and avoids contamination of the liquid cryogen in the event of a leak.

Numerous examples are provided herein to enhance understanding of the present disclosure. A specific set of examples are provided as follows.

In a first example, there is disclosed a high temperature superconductor apparatus comprising: a thermally insulated vessel for containing liquid cryogen; a thermal insulation barrier disposed in the vessel and defining an upper compartment within the vessel above the barrier and a lower compartment within the vessel below the barrier, and the upper compartment being interconnected to the lower compartment by a passage to allow pressure equalization between the upper compartment and the lower compartment; high temperature superconductor mounted within the lower compartment for immersion in the liquid cryogen; a cryogenic refrigerator having a cold head thermally coupled to the high temperature superconductor for maintaining the high temperature superconductor below a transition temperature for superconductivity; and a temperature controller for maintaining a temperature of the liquid cryogen in the upper compartment at a temperature of at least a boiling point of the liquid cryogen at atmospheric pressure when the lower compartment and at least a portion of the upper compartment are filled with the liquid cryogen.

In a second example, there is disclosed a high temperature superconductor apparatus according to the preceding first example, wherein the temperature controller includes a heat flow control device for controlling a flow of heat from the upper compartment to the lower compartment.

In a third example, there is disclosed a high temperature superconductor apparatus according to the preceding second example, wherein the heat flow control device includes at least one adjustable opening in the barrier.

In a fourth example, there is disclosed a high temperature superconductor apparatus according to the preceding third example, wherein the adjustable opening allows mixing of liquid cryogen from the lower compartment with liquid cryogen in the upper compartment.

In a fifth example, there is disclosed a high temperature superconductor apparatus according to the preceding third example or fourth example, wherein the vessel is sealed to contain gas pressure within the vessel at a pressure of at least atmospheric pressure, and the temperature controller includes a mechanical actuator coupled to the adjustable opening and actuated by the gas pressure within the vessel for increasing the adjustable opening in the barrier in response to an increase in the gas pressure.

In a sixth example, there is disclosed a high temperature superconductor apparatus according to any of the preceding examples first to fifth, wherein the heat flow control device includes a pump for circulating liquid cryogen between the lower compartment and the upper compartment.

In a seventh example, there is disclosed a high temperature superconductor apparatus according to any of the preceding examples first to sixth, wherein the heat flow control device includes a mixer for mixing liquid cryogen from the lower compartment with liquid cryogen in the upper compartment.

In an eighth example, there is disclosed a high temperature superconductor apparatus according to any of the preceding examples first to seventh, wherein the vessel is sealed to contain gas pressure within the vessel at a pressure of at least atmospheric pressure, and the temperature controller includes a pressure sensor for sensing the gas pressure within the vessel, and the temperature controller is responsive to the sensed gas pressure to control the temperature of the liquid cryogen in the upper compartment to maintain the gas pressure sensed by the pressure sensor at a set-point pressure.

In a ninth example, there is disclosed a high temperature superconductor apparatus according to any of the preceding examples first to eighth, wherein the temperature controller includes a temperature sensor for sensing temperature of liquid cryogen in the upper compartment, and the temperature controller is responsive to the temperature sensed by the temperature sensor to control the temperature of the liquid cryogen in the upper compartment to maintain the temperature sensed by the temperature sensor at a set-point temperature.

In a tenth example, there is disclosed a high temperature superconductor apparatus as claimed in any of the preceding examples first to ninth, wherein the temperature controller includes an electrical heater for selectively supplying heat to the liquid cryogen in the upper compartment.

In an eleventh example, there is disclosed a high temperature superconductor apparatus as claimed in any of the preceding examples first to tenth, wherein the surface temperature controller includes another cryogenic refrigerator having a cold head for selectively removing heat from the liquid cryogen in the upper compartment.

In a twelfth example, there is disclosed a method of operating a high temperature superconductor apparatus, the apparatus having a thermally insulated vessel containing liquid cryogen, a thermal insulation barrier disposed in the vessel and defining an upper compartment within the vessel above the barrier and a lower compartment within the vessel below the barrier and the upper compartment being interconnected to the lower compartment by a passage to allow pressure equalization between the upper compartment and the lower compartment, liquid cryogen contained in the lower compartment and in at least a portion of the upper compartment, high temperature superconductor mounted within the lower compartment and immersed in the liquid cryogen, and a cryogenic refrigerator having a cold head thermally coupled to the high temperature superconductor to maintain the high temperature superconductor below a transition temperature for superconductivity, said method comprising maintaining a temperature of the liquid cryogen in the upper compartment at a temperature of at least a boiling point of the liquid cryogen at atmospheric pressure.

In a thirteenth example, there is disclosed a method according to the preceding twelfth example, wherein the liquid cryogen is liquid nitrogen.

In a fourteenth example, there is disclosed a method according to the preceding twelfth or thirteenth example, which includes maintaining the lower compartment at a temperature below seventy degrees Kelvin.

In a fifteenth example, there is disclosed a method according to any of the preceding examples twelfth to fourteenth, wherein the vessel is sealed to contain gas pressure within the vessel at a pressure of at least atmospheric pressure, and the surface temperature is controlled to maintain the gas pressure in the range of zero to two kPa above atmospheric pressure.

In a sixteenth example, there is disclosed a method according to any of the preceding examples twelfth to fifteenth, which includes maintaining the temperature of the liquid cryogen in the upper compartment by controlling a flow of heat from the upper compartment to the lower compartment.

In a seventeenth example, there is disclosed a method according to any of the preceding examples twelfth to sixteenth, which includes controlling the flow of heat from the upper compartment to the lower compartment by adjusting an opening in the barrier.

In an eighteenth example, there is disclosed a method according to any of the preceding seventeenth example, wherein the adjusting of the opening in the barrier controls a mixing of liquid cryogen from the lower compartment with liquid cryogen in the upper compartment.

In an nineteenth example, there is disclosed a method according to the preceding seventeenth or eighteenth example, wherein the vessel is sealed to contain gas pressure within the vessel at a pressure of at least atmospheric pressure, and the opening is mechanically actuated by gas pressure within the vessel to increase the opening in response to an increase in the gas pressure.

In a twentieth example, there is disclosed a method according to any of the preceding examples sixteenth to nineteenth, which includes maintaining the temperature of the liquid cryogen in the upper compartment by controlling a pump circulating liquid cryogen between the lower compartment and the upper compartment.

In a twenty-first example, there is disclosed a method according to any of the preceding examples sixteenth to twentieth, which includes maintaining the temperature of the liquid cryogen in the upper compartment by controlling a mixer mixing liquid cryogen from the lower compartment with liquid cryogen in the upper compartment.

In a twenty-second example, there is disclosed a method according to any of the preceding examples twelfth to twenty-first, wherein the vessel is sealed to contain gas pressure within the vessel at a pressure of at least atmospheric pressure, and the method includes sensing the gas pressure within the vessel and controlling the temperature of the liquid cryogen in the upper compartment in response to the sensed gas pressure in order to maintain the sensed gas pressure at a pressure set point.

In a twenty-third example, there is disclosed a method according to any of the preceding examples twelfth to twenty-second, which includes sensing temperature of the liquid cryogen in the upper compartment, and controlling the temperature of the liquid cryogen in the upper compartment in response to the sensed temperature in order to maintain the sensed temperature at a temperature set point.

The invention claimed is:

1. A high temperature superconductor apparatus comprising:

a thermally insulated vessel for containing liquid cryogen;

a thermal insulation barrier disposed in the vessel and defining an upper compartment within the vessel above the barrier and a lower compartment within the vessel below the barrier, and the upper compartment being interconnected to the lower compartment by a passage to allow pressure equalization between the upper compartment and the lower compartment;

a high temperature superconductor mounted within the lower compartment for immersion in the liquid cryogen;

a cryogenic refrigerator having a cold head thermally coupled to the high temperature superconductor for maintaining the high temperature superconductor below a transition temperature for superconductivity; and a temperature controller for maintaining a temperature of the liquid cryogen in the upper compartment at a temperature of at least a boiling point of the liquid cryogen at atmospheric pressure when the lower compartment and at least a portion of the upper compartment are filled with the liquid cryogen, wherein the temperature controller includes a heat flow control device for controlling a flow of heat from the upper compartment to the lower compartment by circulating liquid cryogen between the lower compartment and the upper compartment and/or by mixing liquid cryogen from the lower compartment with liquid cryogen in the upper compartment.

2. The high temperature superconductor apparatus as claimed in claim 1, wherein the heat flow control device comprises at least one adjustable opening in the barrier.

3. The high temperature superconductor apparatus as claimed in claim 2, wherein the adjustable opening allows mixing of liquid cryogen from the lower compartment with liquid cryogen in the upper compartment.

4. The high temperature superconductor apparatus as claimed in claim 2, wherein the vessel is sealed to contain gas pressure within the vessel at a pressure of at least atmospheric pressure, and the temperature controller includes a mechanical actuator coupled to the adjustable opening and actuated by the gas pressure within the vessel for increasing the adjustable opening in the barrier in response to an increase in the gas pressure.

5. The high temperature superconductor apparatus as claimed in claim 2, wherein the at least one adjustable opening is a butterfly valve or a louver configured to be opened and closed.

6. The high temperature super conductor apparatus as claimed in claim 5, wherein the heat flow control device includes a pump or a mixer for circulating liquid cryogen between the lower compartment and the upper compartment.

7. The high temperature superconductor apparatus as claimed in claim 5, wherein the temperature controller includes an actuator coupled to the butterfly valve or the louver, the actuator configured to open or close the butterfly value or the louver to control the flow of heat from the upper compartment to the lower compartment.

8. The high temperature superconductor apparatus as claimed in claim 2, wherein the at least one adjustable opening is a valve or vent configured to be opened or closed by rotation.

9. The high temperature superconductor apparatus as claimed in claim 8, wherein the heat flow control device includes a pump or a mixer for circulating liquid cryogen between the lower compartment and the upper compartment.

10. The high temperature superconductor apparatus as claimed in claim 1, wherein the heat flow control device includes a pump for circulating liquid cryogen between the lower compartment and the upper compartment.

11. The high temperature superconductor apparatus as claimed in claim 1, wherein the heat flow control device includes a mixer for mixing liquid cryogen from the lower compartment with liquid cryogen in the upper compartment.

12. The high temperature superconductor apparatus as claimed in claim 1, wherein the vessel is sealed to contain gas pressure within the vessel at a pressure of at least atmospheric pressure, and the temperature controller includes a pressure sensor for sensing the gas pressure within the vessel, and the temperature controller is responsive to the sensed gas pressure to control the temperature of the liquid cryogen in the upper compartment to maintain the gas pressure sensed by the pressure sensor at a set-point pressure.

13. The high temperature superconductor apparatus as claimed in claim 1, wherein the temperature controller includes a temperature sensor for sensing temperature of liquid cryogen in the upper compartment, and the temperature controller is responsive to the temperature sensed by the temperature sensor to control the temperature of the liquid cryogen in the upper compartment to maintain the temperature sensed by the temperature sensor at a set-point temperature.

14. The high temperature superconductor apparatus as claimed in claim 1, wherein the temperature controller includes an electrical heater for selectively supplying heat to the liquid cryogen in the upper compartment.

15. The high temperature superconductor apparatus as claimed in claim 1, wherein the temperature controller includes another cryogenic refrigerator having a cold head for selectively removing heat from the liquid cryogen in the upper compartment.

16. A method of operating a high temperature superconductor apparatus, the apparatus having a thermally insulated vessel containing liquid cryogen, a thermal insulation barrier disposed in the vessel and defining an upper compartment within the vessel above the barrier and a lower compartment within the vessel below the barrier and the upper compartment being interconnected to the lower compartment by a passage to allow pressure equalization between the upper compartment and the lower compartment, liquid cryogen contained in the lower compartment and in at least a portion of the upper compartment, high temperature superconductor mounted within the lower compartment and immersed in the liquid cryogen, and a cryogenic refrigerator having a cold head thermally coupled to the high temperature superconductor to maintain the high temperature superconductor below a transition temperature for superconductivity, and a temperature controller configured for maintaining a temperature of the liquid cryogen in the upper compartment wherein the temperature controller includes a heat flow control device for controlling a flow of heat from the upper compartment to the lower compartment, said method comprising maintaining a temperature of the liquid cryogen in the upper compartment at a temperature of at least a boiling point of the liquid cryogen at atmospheric pressure.

17. The method as claimed in claim 16, wherein the vessel is sealed to contain gas pressure within the vessel at a pressure of at least atmospheric pressure, and the surface temperature is controlled to maintain the gas pressure in the range of zero to two kPa above atmospheric pressure.

18. The method as claimed in claim 16, which includes maintaining the temperature of the liquid cryogen in the upper compartment by controlling a flow of heat from the upper compartment to the lower compartment by adjusting an opening in the barrier.

19. The method as claimed in claim 18, wherein the vessel is sealed to contain gas pressure within the vessel at a pressure of at least atmospheric pressure, and the opening is mechanically actuated of gas pressure within the vessel to increase the opening in response to an increase in the gas pressure.

20. The method as claimed in claim 16, which includes maintaining the temperature of the liquid cryogen in the upper compartment of controlling a pump circulating liquid cryogen between the lower compartment and the upper compartment.

* * * * *